US008622592B1

(12) United States Patent
Liu et al.

(10) Patent No.: US 8,622,592 B1
(45) Date of Patent: Jan. 7, 2014

(54) LED LAMP WITH RADIATOR AND METHOD FOR MANUFACTURING THE SAME

(71) Applicants: You-Xue Liu, Guangdong (CN); Qian-Jin Cai, Guangdong (CN); Shi-Song Zheng, Guangdong (CN); Yi-San Liu, Guangdong (CN); Chin-Chung Chen, New Taipei (TW)

(72) Inventors: You-Xue Liu, Guangdong (CN); Qian-Jin Cai, Guangdong (CN); Shi-Song Zheng, Guangdong (CN); Yi-San Liu, Guangdong (CN); Chin-Chung Chen, New Taipei (TW)

(73) Assignees: Champ Tech Optical (Foshan) Corporation, Foshan (CN); Foxconn Technology Co., Ltd., New Taipei (TW)

( * ) Notice: Subject to any disclaimer, the term of this patent is extended or adjusted under 35 U.S.C. 154(b) by 0 days.

(21) Appl. No.: 13/663,491

(22) Filed: Oct. 30, 2012

(30) Foreign Application Priority Data

Aug. 27, 2012 (CN) ..... 2012 1 0307457

(51) Int. Cl.
*F21V 15/00* (2006.01)
*F21V 29/00* (2006.01)
*F21V 17/00* (2006.01)

(52) U.S. Cl.
USPC ..... 362/373; 362/362; 362/374; 362/375; 362/364; 362/368

(58) Field of Classification Search
None
See application file for complete search history.

(56) References Cited

U.S. PATENT DOCUMENTS

| | | | | | |
|---|---|---|---|---|---|
| 5,583,316 | A * | 12/1996 | Kitahara et al. | ..... | 174/16.3 |
| 6,166,904 | A * | 12/2000 | Kitahara et al. | ..... | 361/697 |
| 8,529,100 | B1 * | 9/2013 | Patrick et al. | ..... | 362/294 |
| 2013/0155701 | A1 * | 6/2013 | Osawa et al. | ..... | 362/382 |

* cited by examiner

*Primary Examiner* — Natalie Walford
(74) *Attorney, Agent, or Firm* — Altis Law Group, Inc.

(57) ABSTRACT

An LED lamp includes a radiator, two caps and a light emitting module. The radiator includes a base and a plurality of fins parallel to each other extends along a face of the base, the fins are integrally formed with the base. The two caps are aligned with two opposite ends of the radiator along a longitudinal direction. The light emitting module includes several circuit boards attaching to another face of the base and a plurality of LEDs disposed on the circuit boards. The circuit boards are arranged along the longitudinal direction of the fins, the radiator is cut into pieces with different length according to the arrangement of the circuit board. The present disclosure also provides a method for manufacturing the LED lamp.

11 Claims, 5 Drawing Sheets

LED LAMP WITH RADIATOR AND METHOD FOR MANUFACTURING THE SAME

BACKGROUND

1. Technical Field

The present disclosure generally relates to a lamp with a radiator and a method for manufacturing the lamp, and more particularly to a light emitting diode (LED) lamp with a radiator and a method for manufacturing the LED lamp.

2. Description of the Related Art

An LED lamp utilizing LEDs as a source of illumination is widely used in many fields because the LEDs have features of long-term reliability, environment friendliness and low power consumption. It is well-known that a conventional lamp utilizes fluorescent lights as a source of illumination. With the development of the LED lamp, the LED lamp is intended to be a cost-effective yet high quality replacement for the conventional fluorescent lamp.

Generally, the LED lamp comprises a bracket integrally formed in a manner of metal die casting or metal extrusion by a die/mould, and a plurality of LED modules received in the bracket. The LED lamp can achieve a constant illumination intensity because a dimension of the bracket is constant. For achieving different illumination intensities according to different requirements, the dimension of the bracket has to be changed. However, a change of the die/mould for forming the bracket raises a considerable design cost burden. Furthermore, obtaining different dies/moulds with different sizes requires additional manufacture and material cost.

What is needed, therefore, is an LED lamp whose light intensity can be easily adjusted by increasing or decreasing the number of LEDs thereof for meeting different illumination demands.

BRIEF DESCRIPTION OF THE DRAWINGS

Many aspects of the present embodiments can be better understood with reference to the following drawings. The components in the drawings are not necessarily drawn to scale, the emphasis instead placed upon clearly illustrating the principles of the present embodiments. Moreover, in the drawings, like reference numerals designate corresponding parts throughout the various views.

DETAILED DESCRIPTION

Figure 1:
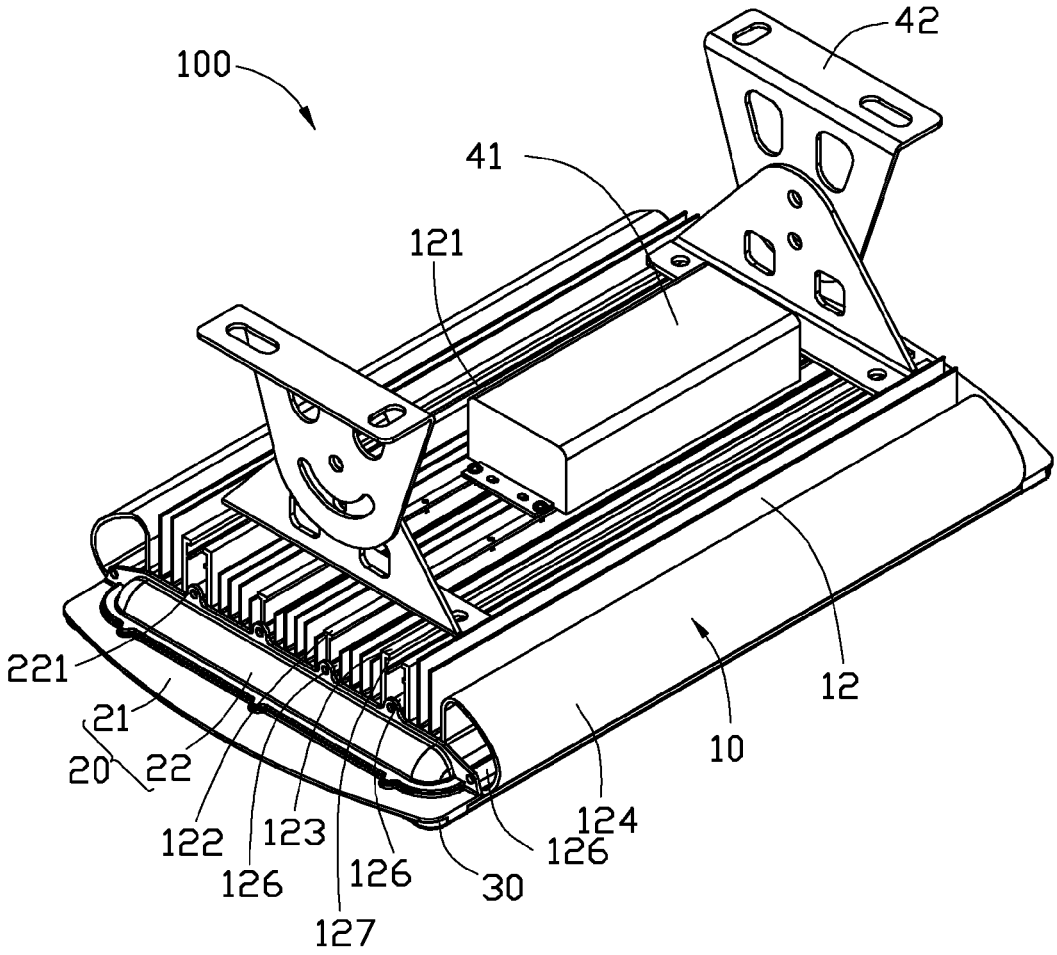
FIG. 1 is an assembled, isometric view of an LED lamp in accordance with an embodiment of the disclosure.

Referring to FIG. 1, an LED lamp 100 in accordance with an exemplary embodiment is provided as a projection lamp. The LED lamp 100 includes a radiator 10, two caps 20 attached to two opposite ends of the radiator 10 respectively, a light emitting module 30 disposed at a bottom face of the radiator 10, and a power device 41 and two stents 42 disposed at a top face of the radiator 10.

Figure 2:
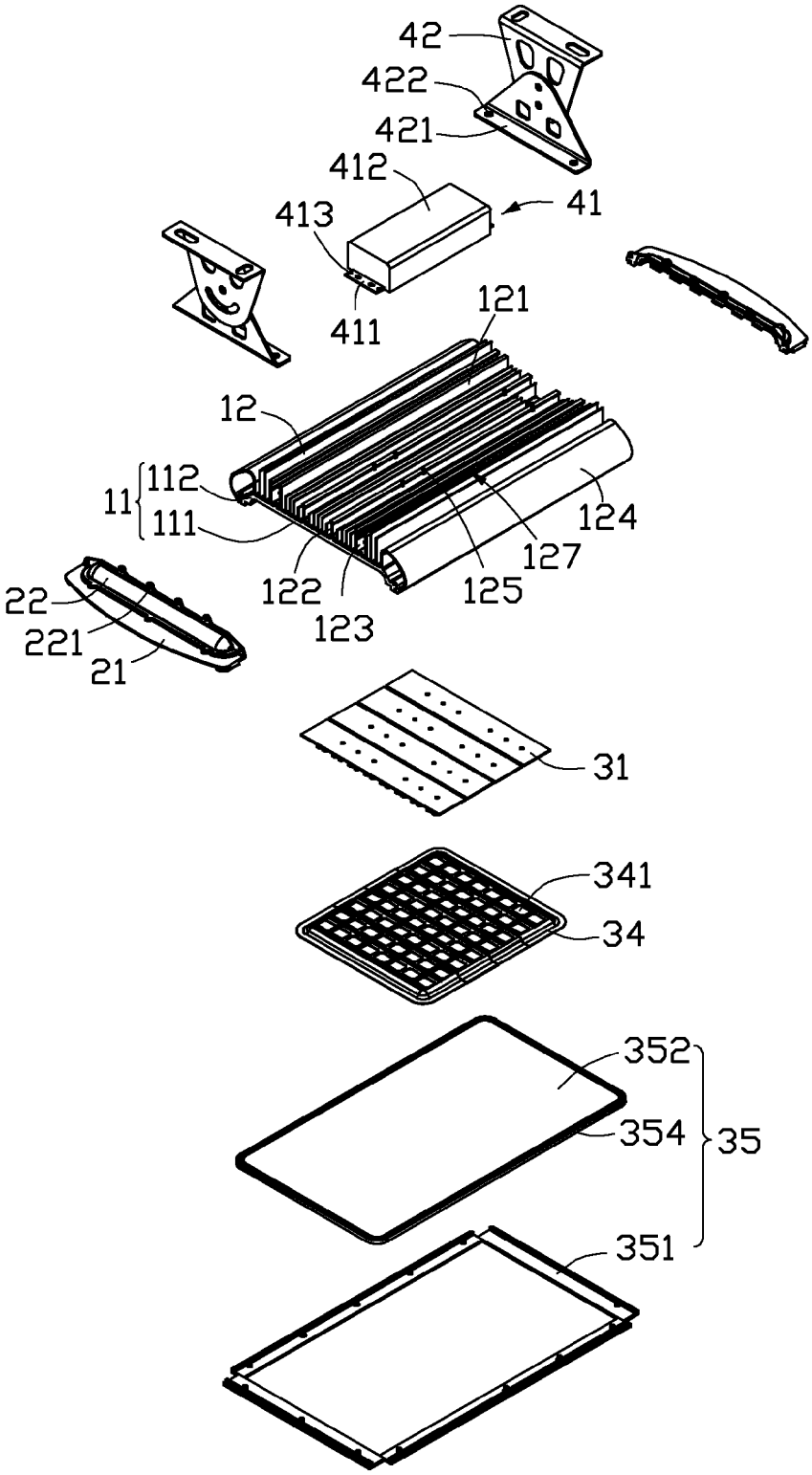
FIG. 2 is an exploded view of the LED lamp of FIG. 1.
Figure 3:
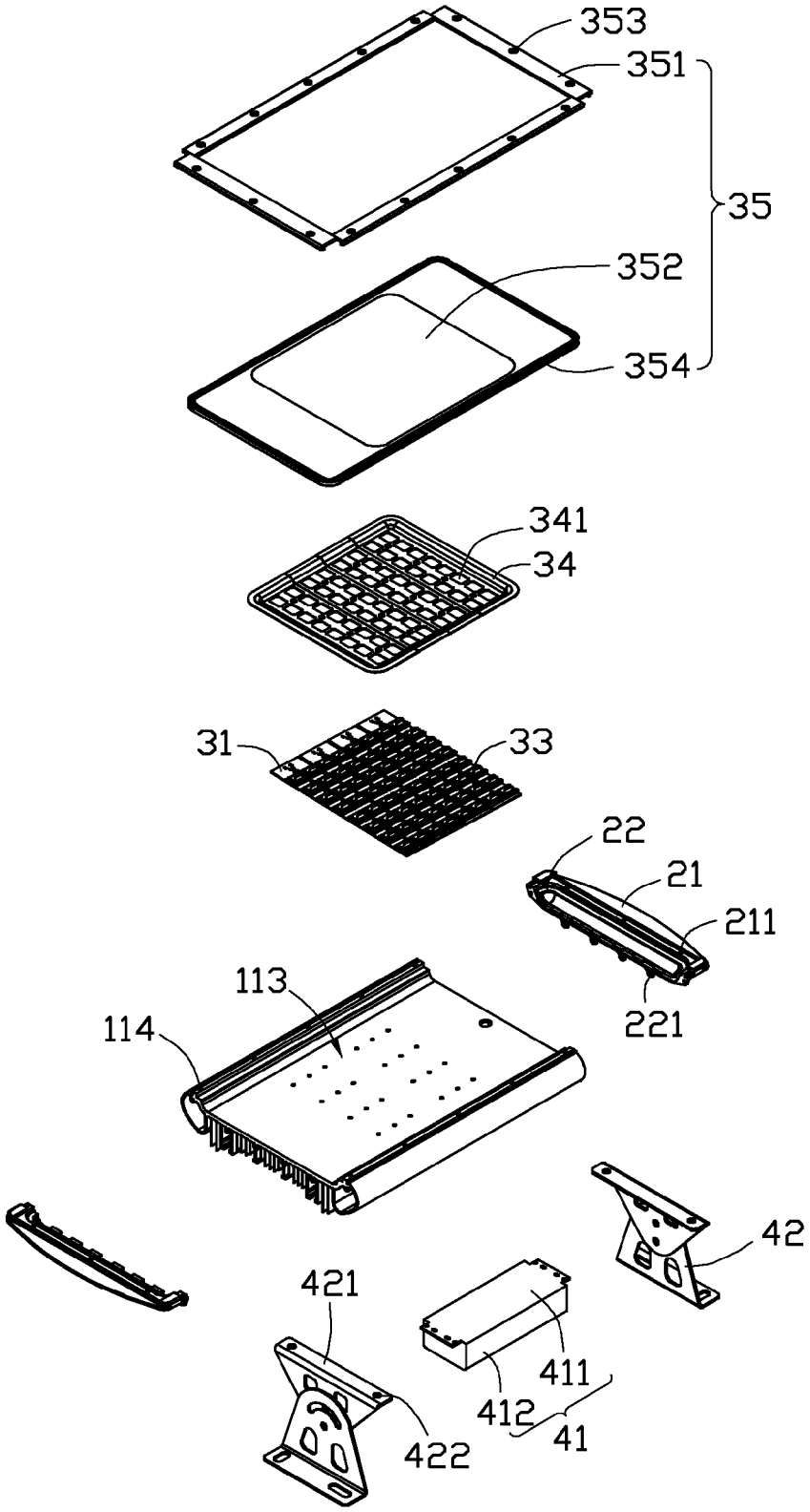
FIG. 3 is an inverted view of the LED lamp FIG. 2.

Referring to FIG. 2 and FIG. 3, the radiator 10 is integrally preformed of a metal with good heat conductivity such as aluminum, copper or an alloy thereof. In this embodiment, an elongated extruded semi-finished product is cut into pieces with different lengths, and the radiator 10 is selected from one of the pieces. The radiator 10 includes a rectangular base 11 and a plurality of fins 12 disposed on a top face of the base 11. The fins 12 are parallel to and spaced from each other.

For facilitating description, a longitudinal extending direction of the base 11 is defined as a longitudinal direction, and a direction parallel to the base 11 and vertical to the longitudinal direction is defined as a transverse direction. The base 11 includes a main plate 111 and two flanges 112 extending aslant downward from two opposite sides of the main plate 111 along the transverse direction, respectively. The two flanges 112 extend away from each other along the transverse direction. The flanges 112 also extend along the longitudinal direction and have a length identical to that of the main plate 111. The flanges 112 are integrally formed with the main plate 111 to form a recess 113. A plurality of through holes 114 is disposed uniformly on bottom sides of the flanges 112.

Each of the fins 12 extends along the longitudinal direction. The fins 12 located at a middle of the radiator 10 are lower than other fins 12 to form a receiving portion 121. The fins 12 include a first group 122, a second group 123 located at two lateral sides of the first group 122 symmetrically, and a third group 124 located at two lateral sides of the main plate 111 symmetrically and covering the flanges 112. The receiving portion 121 is defined on the first group 122 and between two parts of the second group 123.

Figure 4:
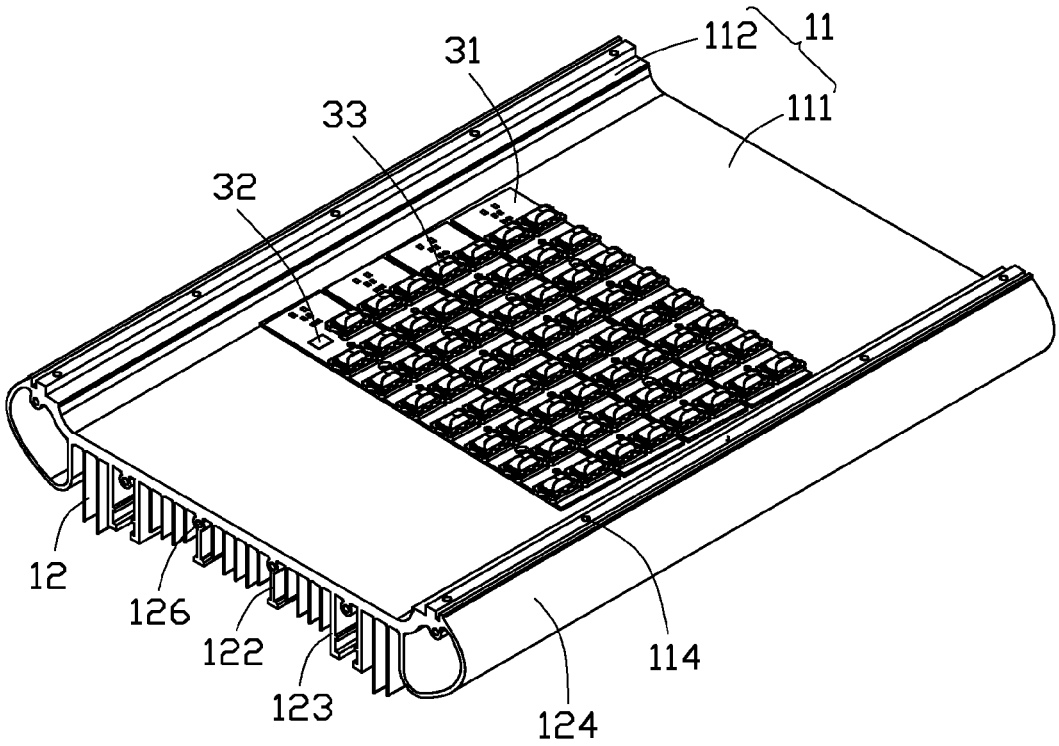
FIG. 4 is an assembled, isometric view of a radiator and a circuit board of the LED lamp of FIG. 1.

Also referring to FIG. 4, two fins 12 of the first group 122 have "T" shaped top ends and define a plurality of positioning holes 125 on the top ends. The two fins 12 of the first group 122 are spaced by other fins 12 of the first group 122. Two pairs of fins 12 of the second group 123 located at two opposite lateral sides of the first group 122 have branches extending therefrom. The branches extend face to face on each pair of the fins 12 of the second group 123. A sliding channel 127 is defined in each pair of the fins 12 of the second group 123. The number of the third group 124 is two, and each extends upward and then outward and downward and connects a free end of a corresponding flange 112 to form a tube with the corresponding flange 112 for preventing an operator from being injured when assembling the LED lamp. Two inserting holes 126 are defined in bottom ends of the two fins of the first group 122, respectively. Two additional inserting holes 126 are defined below the sliding channels 127. Another two inserting holes 126 are defined in ends of the fins 12 of the third group 124 and located at top sides of the flanges 112. The inserting holes 126 extend through the corresponding fin 12 along the longitudinal direction.

The two caps 20 are aligned with two opposite ends of the radiator 10 along the longitudinal direction, respectively. The caps 20 are respectively engaged with two opposite ends of the radiator 10. Each cap 20 includes a positioning plate 21 and a seal housing 22 extending upward from one end of the positioning plate 21 nearby the radiator 10. The positioning plate 21 extends from the free end of the flange 112 and is parallel to the main plate 111. A plurality of through holes 211 are disposed uniformly on a bottom side of the positioning plate 21. A periphery of the seal housing 22 matches with the flanges 112 and the main plate 111 to enclose the recess 113 of the radiator 10. Six lugs 221 are formed on a top side of the seal housing 22 corresponding to the inserting holes 126. The lugs 221 are annular for screws inserting and extending through the inserting holes 126, whereby the caps 20 are secured on the radiator 10.

Referring to FIG. 3 and FIG. 4, the light emitting module 30 includes a plurality of circuit boards 31, a plurality of LEDs 32, a plurality of lenses 33 each embracing an LED 32, a fixed board 34 and a diffuser 35.

Specifically, each circuit board 31 is attached to a bottom face of the main plate 111 and received in the recess 113. Each circuit board 31 is rectangular, and a longitudinal direction of the circuit board 31 is vertical to the longitudinal direction of the radiator 10. The plurality of LEDs 21 is evenly disposed at a bottom face of the circuit board 31. The lens 33 correspondingly embraces the LED 32 to promote illumination effect. The fixed board 34 is reticular and defines a plurality of fixing holes 341 corresponding to the lenses 33. The lens 33 extends through the fixing hole 341. The diffuser 35 includes a holder 351 and a transparent body 352 latched in the holder 351. The transparent body 352 covers the plurality of lens 33. A plurality of through holes 353 are disposed at the holder 351 corresponding to the through holes 114 of the flanges 112 and the through holes 211 of the positioning plate 21, for screws inserting through and assembling the radiator 10, the caps 20 and the diffuser 35 together. A seal ring 354 is disposed between the holder 351 and the transparent body 352 for preventing water leakage.

The power device 41 is disposed on the fins 12 along the longitudinal direction of the radiator 10. The power device 41 comprises a substrate 411 and a power source 412 disposed on the substrate 411. The substrate 411 has two ends extending beyond the power source 412 along the longitudinal direction of the radiator 10 and defines a plurality of positioning holes 413 on the two ends respectively. The positioning holes 413 are corresponding to the positioning holes 125 located at the first group 122 of the fins 12 for screws inserting through to secure the power device 41 on the radiator 12.

The two stents 42 are disposed on the fins 12 and located at two opposite ends of the power device 41 along the longitudinal direction. A side of each stent 42 nearby the fins 12 includes a fixing part 421 parallel to the main plate 111. The fixing part 421 defines two through holes 422 corresponding to the sliding channel 127 of the second group 123 of the fins 12 for screws inserting through. The securing position of the stents 42 can be changed by sliding the screws along the sliding channel 127. The LED lamp 100 is attached to a relative object (not shown) such as a wall by the stents 42. The LED lamp 100 can match with different stents 42 to form different style lamp, such as street lamp, tunnel lamp.

The circuit boards 31 of the LED lamp 100 are disposed side by side along the longitudinal direction. In a certain application, the radiator 10 is extruded and cut with a longitudinal length according to the number of the circuit boards 31, and then the radiator 10, the caps 20, the light emitting modules 30, the power source and the two stents are assembled together to form the LED lamp 100.

In the above LED lamp 100, the radiator 10 is pre-extruded to form a certain length, and the radiator 10 is then cut into pieces with different lengths according to the arrangement of the circuit board 31 along the longitudinal direction of the radiator 10. Thus, designing different moulds/dies to form radiators 10 with different sizes is not necessary. A further manufacture, design and material costs are omitted and the manufacturing process is simple and convenient for batch production.

Figure 5:
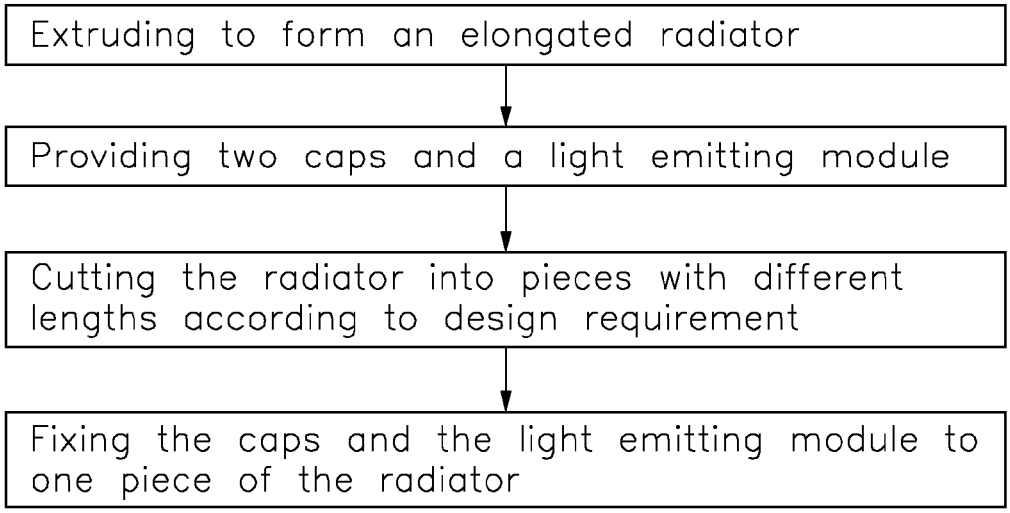
FIG. 5 is a manufacturing flow chart of the LED lamp of FIG. 1.

Referring to FIG. 5, a method for manufacturing the LED lamp 100 is provided as follow:

Extruding to form an elongated radiator 10;

Providing two caps 20 and a light emitting module 30;

Cutting the radiator 10 into pieces with different lengths according to the arrangement of the light emitting module 30; and Fixing the caps 20 and the light emitting module 30 to one piece of the radiator 10.

It is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. An LED (light emitting diode) lamp comprising:

a radiator comprising a base and a plurality of fins integrally formed on a face of the base, the fins being parallel to each other and extending along a longitudinal direction;

two caps engaged with two opposite ends of the radiator in the longitudinal direction; and a light emitting module comprising several circuit boards attaching to another face of the base and a plurality of LEDs disposed on the circuit boards, the circuit boards extending along a transverse direction and arranged side by side along the longitudinal direction, the transverse direction being vertical to the longitudinal direction;

wherein the radiator is selected from one piece of an elongated radiator by cutting into pieces with different lengths according to the arrangement length of the circuit boards in the longitudinal direction.

2. The LED lamp of claim 1, wherein the base comprises a main plate and two flanges extending aslant downward from two opposite sides of the main plate along the transverse direction, the main plate and the flanges being engaged together to form a recess, the light emitting module being received in the recess.

3. The LED lamp of claim 2, wherein the fins comprises a first group, a second group located at two lateral sides of the first group symmetrically, and a third group located at two lateral sides of the main plate symmetrically and covering the flanges, the first group is lower than the second group to form a receiving portion on the first group.

4. The LED lamp of claim 3, wherein two fins of the first group have "T" shaped top ends and define a plurality of positioning holes on the top ends for screws inserting through to secure a power device with positioning holes on the radiator.

5. The LED lamp of claim 3, wherein two pairs of fins of the second group located at two opposite lateral sides of the first group have branches extending therefrom, the branches extend face to face on each pair of the fins of the second group, and a sliding channel is defined in each pair of the fins of the second group for screws inserting through to secure stents on the radiator.

6. The LED lamp of claim 3, wherein the number of the third group is two, and each extends upward and then outward and downward and connects to a free end of the base.

7. The LED lamp of claim 3, wherein two inserting holes are defined in bottom ends of two fins of the first group, two additional inserting holes being defined in bottom ends of two fins of the second group, another two inserting holes being defined in ends of the fins of the third group and located at top sides of the flanges, the inserting holes extending through the corresponding fin along the longitudinal direction.

8. The LED lamp of claim 7, each cap comprises a seal housing, the seal housing being matched with the recess, and a periphery of the seal housing matching with the base, six lugs being formed on a top side of the seal housing corresponding to the inserting holes of the radiator, the lugs being annular for screws inserting and extending through the inserting holes.

9. The LED lamp with a radiator of claim 3, wherein the light emitting module further comprises a plurality of lens embracing the LEDs and a fixed board, the fixed board being reticular and defining a plurality of fixing holes corresponding to the lens, the lens extending through the fixing holes.

10. A method for manufacturing an LED lamp comprising:

extruding to form an elongated radiator;

providing two caps and a light emitting module;

cutting the radiator into pieces with different lengths according to the length of the light emitting module; and fixing the caps and the light emitting module to one piece of the radiator.

11. The method of claim 10, wherein the light emitting module comprises a plurality of circuit boards and a plurality of LEDs mounted on the circuit boards, the circuit boards extending along a transverse direction of the radiator and arranged side by side long a longitudinal direction of the radiator, and the length of the light emitting module being that of the circuit boards along the longitudinal direction.

* * * * *